US008328306B2

(12) United States Patent
Iwamuro et al.

(10) Patent No.: US 8,328,306 B2
(45) Date of Patent: Dec. 11, 2012

(54) LIQUID CONTAINER

(75) Inventors: Takeshi Iwamuro, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 12/829,937

(22) Filed: Jul. 2, 2010

(65) Prior Publication Data

US 2011/0000935 A1 Jan. 6, 2011

(30) Foreign Application Priority Data

Jul. 6, 2009 (JP) ..... 2009-159429
Oct. 28, 2009 (JP) ..... 2009-247721
Dec. 17, 2009 (JP) ..... 2009-286498

(51) Int. Cl.
*B41J 2/195* (2006.01)

(52) U.S. Cl. ..... 347/7; 347/5; 347/6; 347/86

(58) Field of Classification Search ..... 347/14, 347/5, 6, 7, 84, 85, 86
See application file for complete search history.

(56) References Cited

U.S. PATENT DOCUMENTS

| | | | | |
|---|---|---|---|---|
| 4,604,633 | A | 8/1986 | Kimura et al. | |
| 2003/0117450 | A1* | 6/2003 | Usui et al. | 347/7 |
| 2005/0151764 | A1 | 7/2005 | Grady et al. | |
| 2007/0243104 | A1* | 10/2007 | Aoki et al. | 422/58 |
| 2008/0148859 | A1 | 6/2008 | Aoki et al. | |
| 2008/0231676 | A1 | 9/2008 | Shimizu | |
| 2009/0102880 | A1 | 4/2009 | Kimura | |
| 2009/0102897 | A1 | 4/2009 | Mizutani et al. | |

FOREIGN PATENT DOCUMENTS

| | | | |
|---|---|---|---|
| CN | 101219604 | A | 7/2008 |
| EP | 1 864 815 | A1 | 12/2007 |
| JP | 9-174875 | A | 7/1997 |
| JP | 2005-219257 | A | 8/2005 |
| JP | 2007-210330 | A | 8/2007 |
| JP | 2008-037016 | A | 2/2008 |
| JP | 2009-018441 | | 1/2009 |

OTHER PUBLICATIONS

Partial European Search Report dated Sep. 29, 2010 in EP10168534.5.
European Search Report, dated Feb. 15, 2011 in EP Application No. 10168534.5.
First Office Action issued on Jan. 13, 2012 in the corresponding Chinese Patent Appln. No. 201010224720.8 and its English translation.

* cited by examiner

*Primary Examiner* — Laura Martin
(74) *Attorney, Agent, or Firm* — Stroock & Stroock & Lavan LLP

(57) ABSTRACT

A liquid container, which is operable to supply a liquid to a liquid ejecting apparatus, includes: a liquid containing portion capable of containing the liquid; and a liquid supply portion one end of which is connected to the liquid containing portion and the other end of which includes an opening which opens outwardly, the liquid supply portion that allows the liquid to flow from the liquid containing portion to the ejecting apparatus, the liquid supply portion that includes a liquid detecting portion which is operable to detect an amount of the liquid in the liquid container and which includes; a liquid detection chamber that contains the liquid supplied from the liquid containing portion; and a sensor that is disposed in the liquid detection chamber and that outputs a detection signal which is used to detect the amount of the liquid in the liquid container.

5 Claims, 13 Drawing Sheets

LIQUID CONTAINER

Priority is claimed to Japanese patent application Nos. 2009-159429 filed on Jul. 6, 2009, 2009-247721 filed on Oct. 28, 2009, and 2009-286498 filed on Dec. 17, 2009, the disclosure of which, including the specification, drawings and claims, is incorporated herein by reference in its entirety.

BACKGROUND

1. Technical Field

This invention relates to a liquid container that supplies a liquid to a liquid ejecting apparatus.

2. Related Art

A liquid ejecting apparatus, such as an ink-jet recording apparatus, an ink-jet textile printing apparatus, or a microdispenser, is supplied with a liquid, such as ink, from a liquid container, and ejects the liquid. The liquid container (also called the "liquid containing case") includes a liquid containing chamber in which a liquid is contained and a liquid detecting device which is used to detect a residual amount of ink remaining in the liquid container. The liquid containing chamber includes an exhaust port. The liquid detecting device includes a liquid inlet connected to the exhaust port, a liquid detection chamber through which a liquid passes, and a liquid outlet that allows a liquid to flow toward the liquid ejecting apparatus. A liquid container having such a structure is disclosed in, for example, JP-A-2007-210330.

In the liquid container, which is a related art, a liquid containing chamber and a liquid detecting device are structurally-different components, respectively, that are detachable from each other, and an exhaust port of the liquid containing chamber and a liquid inlet of the liquid detecting device are fitted and connected to each other. Therefore, there has been a disadvantageous case in which air (air bubbles) enters in the liquid container from the outside through a liquid outlet of the liquid detecting device and a connection part between the exhaust port of the liquid containing chamber and the liquid inlet of the liquid detecting device, and the air (air bubbles) mixes with the liquid of the liquid container, or in which the liquid evaporates from the connection part. In particular, if air bubbles enter in the liquid container and mix with the liquid contained in the liquid container, there is a possibility that, disadvantageously, false detection of the liquid detecting device will occur, or the liquid will deteriorate.

SUMMARY

An advantage of some aspects of the invention is to provide a technique for preventing the occurrence of problems, such as the mixture of air with a liquid contained in the liquid container.

According to an aspect of the invention, there is provided a liquid container, operable to supply a liquid to a liquid ejecting apparatus, the liquid container comprising: a liquid containing portion capable of containing the liquid; and a liquid supply portion one end of which is connected to the liquid containing portion and the other end of which includes an opening which opens outwardly, the liquid supply portion that allows the liquid to flow from the liquid containing portion to the liquid ejecting apparatus, the liquid supply portion that includes a liquid detecting portion which is operable to detect an amount of the liquid in the liquid container and which includes: a liquid detection chamber that contains the liquid supplied from the liquid containing portion; and a sensor that is disposed in the liquid detection chamber and that outputs a detection signal which is used to detect the amount of the liquid in the liquid container.

The liquid supply portion may include: a first flowpath in which the liquid detection chamber is not disposed and which allows the liquid contained in the liquid containing portion to flow to the liquid ejecting apparatus without passing through the liquid detection chamber; and a second flowpath in which the liquid detection chamber is disposed and which allows the liquid contained in the liquid containing portion to pass through the liquid detection chamber and then flow to the liquid ejecting apparatus.

The liquid container may further include: a check valve that prevents a liquid from flowing to the liquid detection chamber from the opening, the check valve disposed in a downstream flowpath located downstream of the liquid detection chamber in the liquid supply portion in a flow direction in which the liquid is supplied to the liquid ejecting apparatus.

The second flowpath may include a downstream communication flowpath through which the liquid detection chamber and the first flowpath communicate with each other and which allows the liquid that has flowed in the second flowpath from the first flowpath or from the liquid containing portion to flow to the first flowpath when the liquid contained in the liquid containing portion is supplied to the liquid ejecting apparatus, the sensor may be disposed so as to come into contact with the liquid detection chamber, and the sensor may be disposed in the liquid detection chamber so as to be located lower than the downstream communication flowpath when the liquid container is attached to the liquid ejecting apparatus so that the liquid ejecting apparatus is ready to be used.

The sensor may include: a communication flowpath that communicates with the liquid detection chamber; a diaphragm that is a part of the communication flowpath; and a piezoelectric element that outputs a waveform signal corresponding to a residual vibration waveform resulting from vibrations applied to the diaphragm.

The check valve may include a valve body and a valve seat, the liquid detection chamber may include an opening portion in a surface facing the sensor, the liquid detecting portion may include: a flexible element with which the opening portion is closed and which is deformed in accordance with pressure of an inside of the liquid detection chamber; and a movable member, at least one part of the movable member being displaced in accordance with deformation of the flexible element, the movable member capable of bringing the liquid detection chamber and the communication flowpath of the sensor into a non-communication state by displacement of the movable member, the movable member including a through-hole-forming part which functions as the valve seat and in which a through-hole, through which the liquid detection chamber and the downstream flowpath communicate with each other, is formed.

The liquid detection chamber may include an opening portion in a surface facing the sensor, and the liquid detecting portion may include: a flexible element with which the opening portion is closed and which is deformed in accordance with pressure of an inside of the liquid detection chamber; a movable member, the movable member being in contact with the flexible element in the liquid detection chamber, at least one part of the movable member being displaced in accordance with deformation of the flexible element, the movable member capable of bringing the liquid detection chamber and the communication flowpath of the sensor into a non-communication state by displacement of the movable member; and a spring which urges the movable member and the sensor so that a distance between the movable member and the sensor becomes greater.

The liquid detection chamber may include an opening portion in a surface facing the sensor, and the liquid detecting portion may include: a flexible element with which the opening portion is closed and which is deformed in accordance with pressure of an inside of the liquid detection chamber; a movable member, the movable member being in contact with the flexible element in the liquid detection chamber, at least one part of the movable member being displaced in accordance with deformation of the flexible element, the movable member capable of bringing the liquid detection chamber and the communication flowpath of the sensor into a non-communication state by displacement of the movable member; and a spring which urges the movable member and the sensor so that a distance between the movable member and the sensor becomes smaller.

The movable member may include: a fixation part fixed to the liquid detection chamber; and a seal part capable of bringing the liquid detection chamber and the communication flowpath of the sensor into a non-communication state by displacement of the seal part.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the present invention will be described in the following order.

A. First Embodiment

B. Second Embodiment

C. Modifications

A. First Embodiment

A-1: Entire Structure of a Liquid Container

Figure 1:
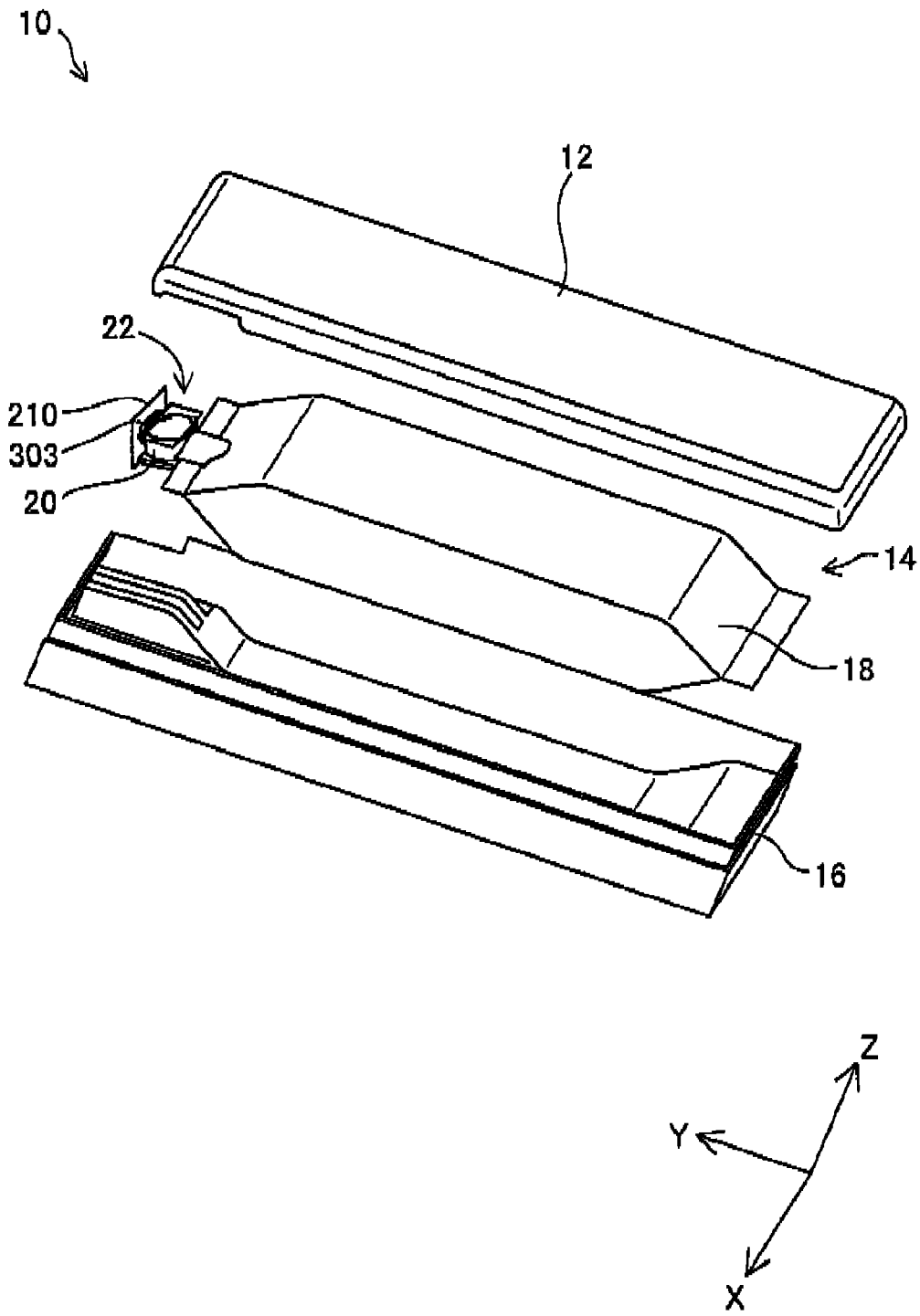
FIG. 1 is a perspective view of the exterior of an ink cartridge according to a first embodiment of the present invention.

FIG. 1 is a perspective view of the exterior of an ink cartridge according to a first embodiment of the present invention. X, Y, and Z axes are shown in FIG. 1 in order to specify a direction. The ink cartridge 10 includes a first case 12, a second case 16, and a liquid container (also called an "ink pack") 14. The ink pack 14 is contained in the second case 16, and the first case 12 is attached to the second case 16, thus an ink cartridge 10 is produced. The first and second cases 12 and 16 are integrally molded according to a resin molding process, respectively. An insertion opening (not shown) is formed in a surface on the side in the positive direction of the Y axis of the second case 16 so that an ink supply needle (liquid supply needle) of a printer (a liquid ejecting apparatus) can be inserted into this insertion opening.

The ink pack 14 includes a liquid containing portion 18 and a liquid supply portion 20. The liquid containing portion 18 is shaped like a bag, and contains ink therewithin. The liquid containing portion 18 is made of an aluminum-laminated multilayer film formed by laying an aluminum layer on a resin film layer, and is flexible.

One end of the liquid supply portion 20 is connected to the liquid containing portion 18. An outwardly-bored open hole 303 is formed on the other end of the liquid supply portion 20. The liquid supply portion 20 includes a liquid detecting portion 22 which is used to detect the amount (hereinafter, referred to as "ink residual amount") of ink contained in the ink pack 14 and a liquid discharge flowpath (not shown) through which ink contained in the ink pack 14 is discharged toward the printer. In a state before attaching the ink cartridge 10 to the printer, the open hole 303 is sealed with a film 210 so that a liquid does not leak toward the outside.

A-2. Flowpath Structure of the Liquid Supply Portion

For easy understanding of this embodiment, a description will be first given of a structure of an ink flowpath of the liquid supply portion 20 and an ink flow produced when ink is supplied to the printer, before describing a detailed structure of the liquid supply portion 20.

Figure 2:
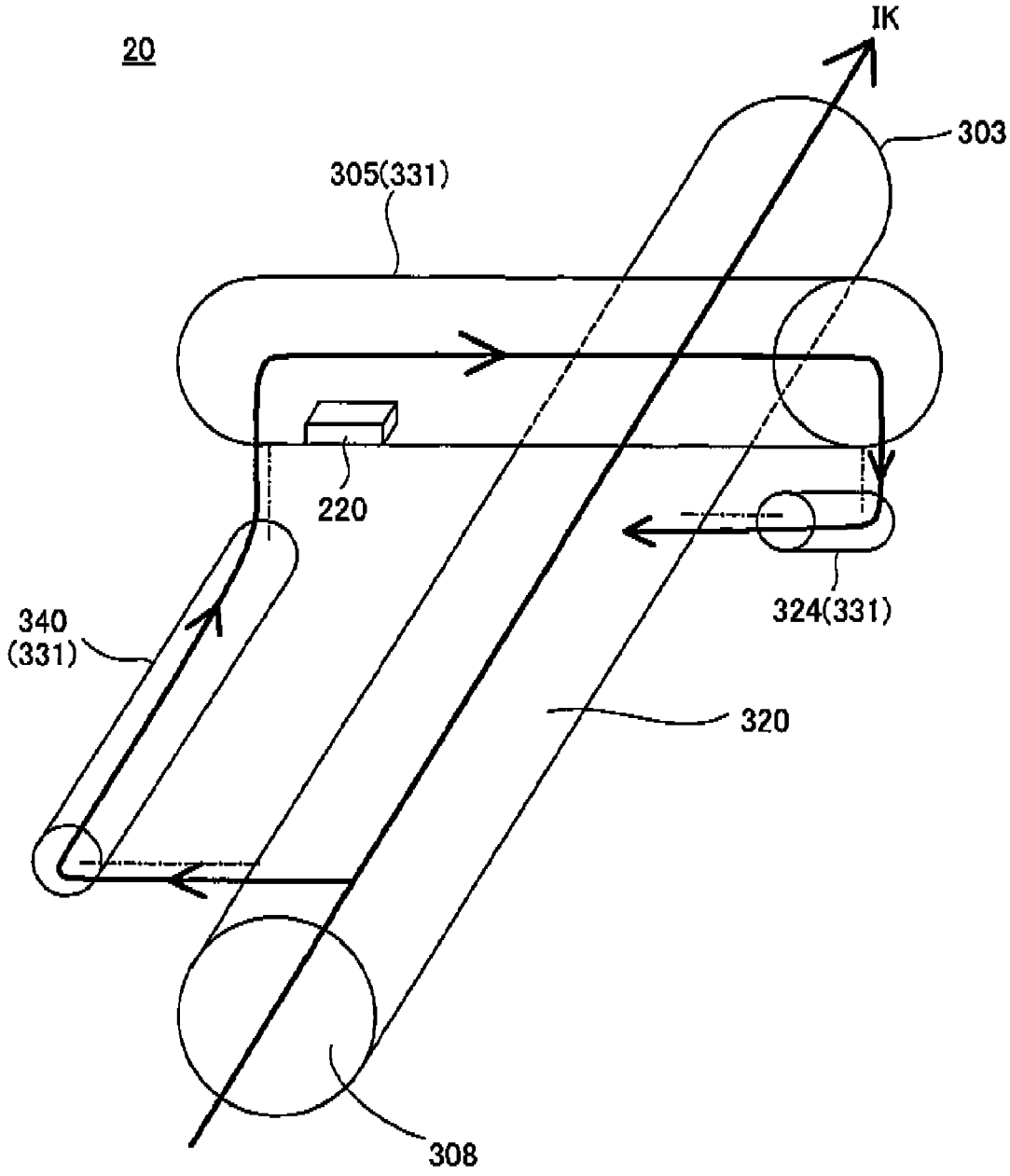
FIG. 2 is a schematic view of ink flowpaths formed in a liquid supply portion.

FIG. 2 is a schematic view of ink flowpaths formed in the liquid supply portion 20. The direction of an arrow shown in the figure indicates a direction in which, when ink IK is supplied to the printer, this ink flows. The alternate long and short dash line shown in the figure indicates that these flowpaths are connected each other.

The liquid supply portion 20 includes a liquid discharge flowpath (first flowpath) 320 and a liquid detection flowpath (second flowpath) 331. The liquid detection flowpath 331 includes an upstream communication flowpath 340, a liquid detection chamber 305, and a downstream communication flowpath (downstream flowpath) 324. A sensor unit 220 which is used to detect an ink residual amount is disposed in the liquid detection chamber 305. First, a description will be given of the flow of ink of the liquid detection flowpath 331 when ink is supplied to the printer. Part of ink that has flowed into the liquid discharge flowpath 320 from the liquid containing portion 18 (see FIG. 1) through a first opening 308 branches and flows into the upstream communication flowpath 340. Ink that has flowed in the upstream communication flowpath 340 passes through the liquid detection chamber 305 and through the downstream communication flowpath 324 in this order, and then flows to the liquid discharge flowpath 320. Ink that has flowed from the downstream communication flowpath 324 to the liquid discharge flowpath 320 passes through the open hole 303, and is supplied to the printer. In other words, the liquid detection flowpath 331 includes the liquid detection chamber 305 disposed on its flowpath, and allows ink of the liquid containing portion 18 to pass through the liquid detection chamber 305, and then to flow to the printer. On the other hand, the liquid discharge flowpath 320 allows ink of the liquid containing portion 18 to flow directly to the printer without flowing through the liquid detection chamber 305.

The liquid detection flowpath 331 (in more detail, the liquid detection chamber 305) and the liquid discharge flowpath 320 intersect with each other in mutually different planes in the liquid supply portion 20. In other words, the liquid detection chamber 305 and the liquid discharge flowpath 320 are in a state of grade separation.

A-3: Structure of the Liquid Supply Portion

Figure 3:
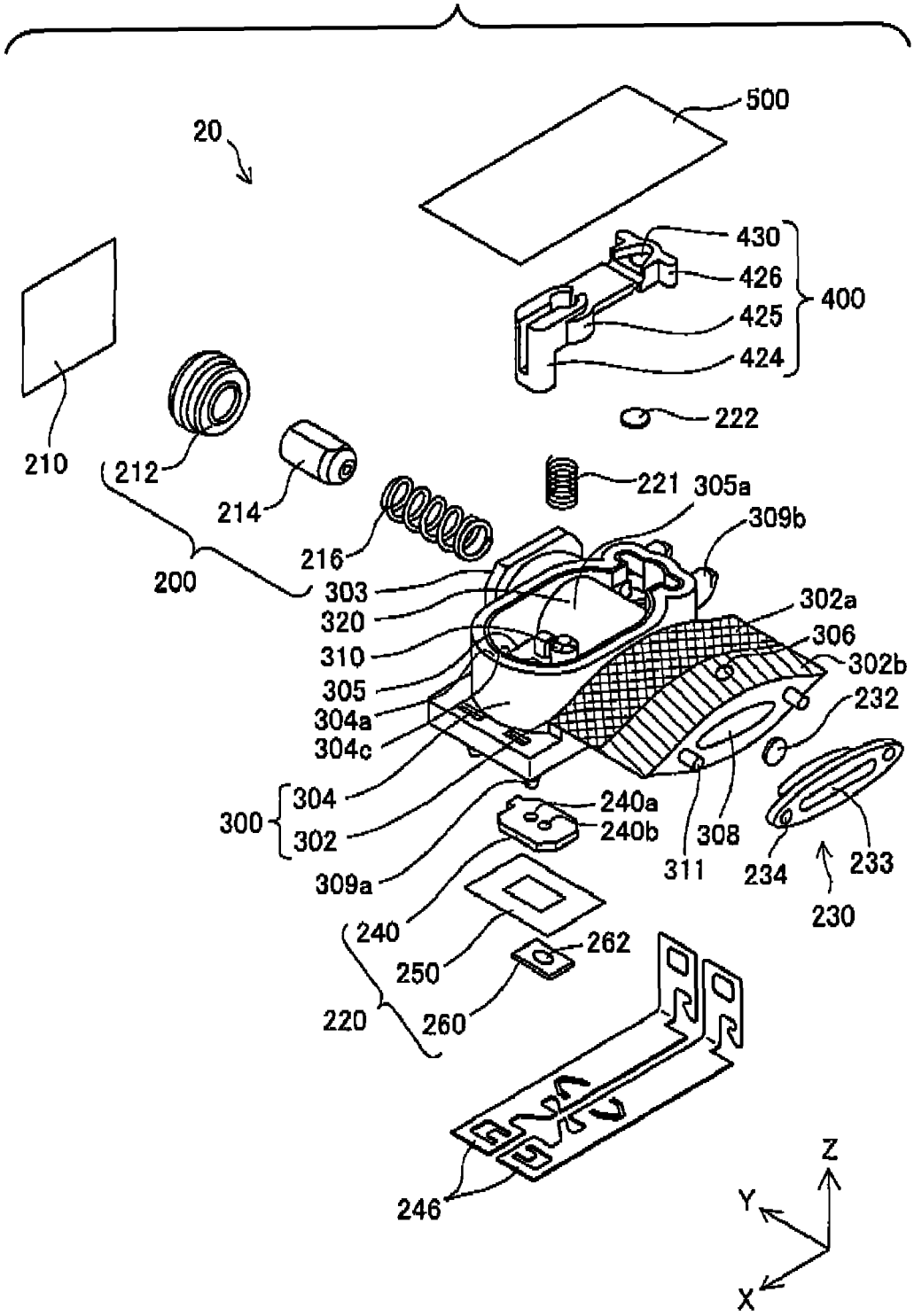
FIG. 3 is an exploded perspective view of the liquid supply portion.
Figure 4:
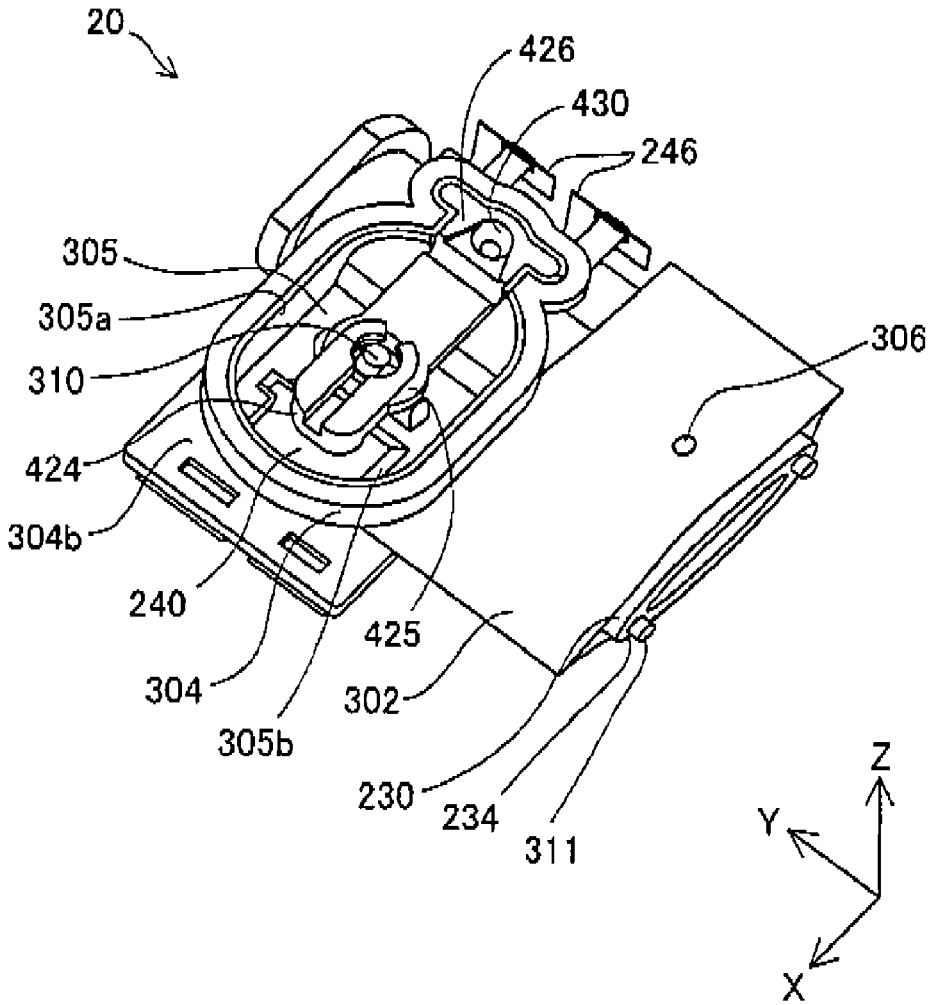
FIG. 4 is a perspective view of the liquid supply portion.
Figure 5A:
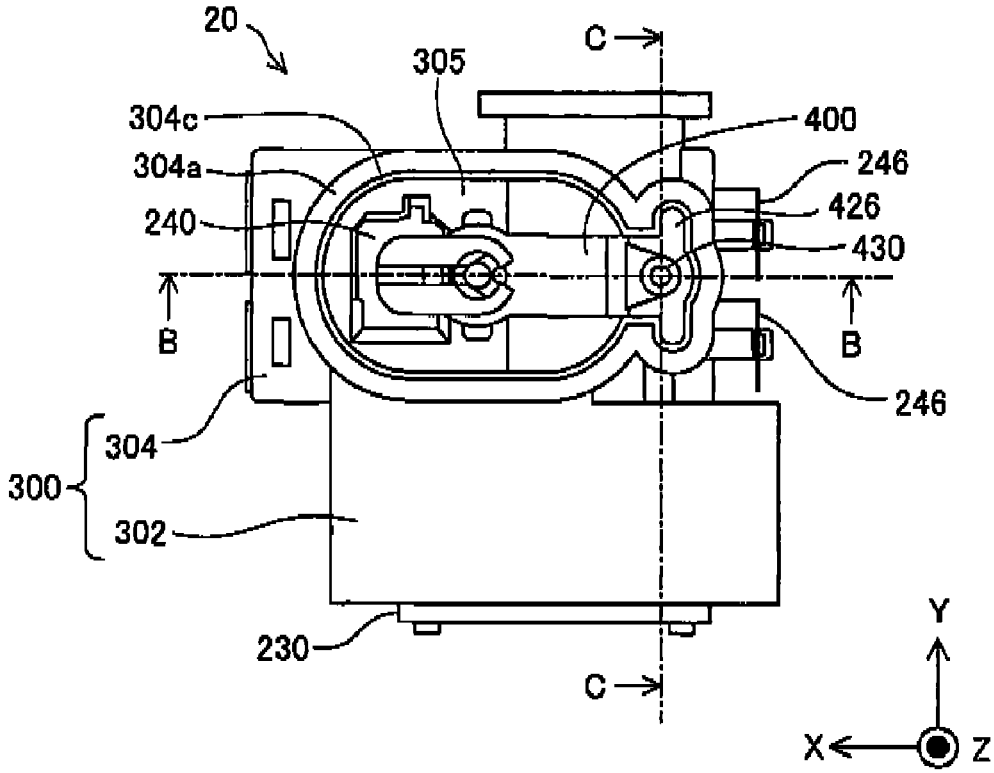
FIG. 5A and FIG. 5B are explanatory views for explaining the liquid supply portion.
Figure 5B:
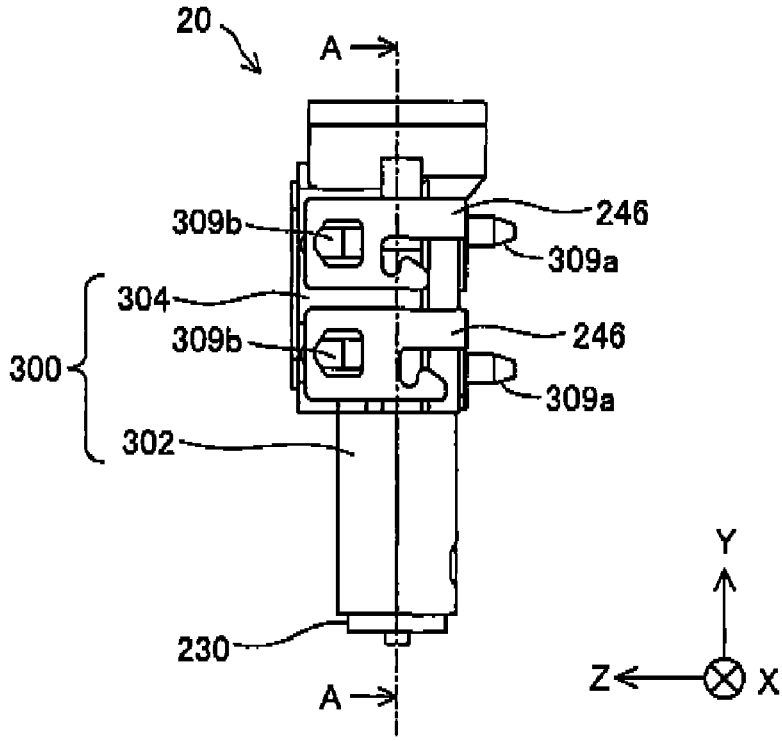

Next, a structure of the liquid supply portion 20 will be described with reference to FIG. 3 to FIG. 5B. X, Y, and Z axes are shown in FIG. 3 to FIG. 5B to specify a direction. FIG. 3 is an exploded perspective view of the liquid supply portion 20. FIG. 4 is a perspective view of the liquid supply portion 20. FIG. 5A and FIG. 5B are explanatory views for explaining the liquid supply portion 20. FIG. 5A shows the liquid supply portion 20 viewed from the side in the positive direction of the Z axis, whereas FIG. 5B shows the liquid supply portion 20 viewed from the side in the negative direction of the X axis. Two films 210 and 500 which are described later are not shown in FIG. 4 to FIG. 5B.

As shown in FIG. 3, the liquid supply portion 20 includes a main supply body 300, a valve-mounted member 230, a sensor unit 220, a seal unit 200, a movable member 400, a spring 221, two films 210 and 500, a junction terminal 246, and two check valves 222 and 232 each of which is a valve body. Herein, the main supply body 300 (in detail, the liquid detection chamber 305 described later), the movable member 400, the flexible film 500, the spring 221, and the sensor unit 220 make up the liquid detecting portion 22 which is used to detect the amount of ink contained in the ink pack 14 (see FIG. 1).

The main supply body 300 is integrally molded with a synthetic resin such as polyethylene. Flowpaths (for example, the liquid discharge flowpath 320 and the liquid detection chamber 305) into which ink that has flowed from the liquid containing portion 18 (see FIG. 1) flows are formed in the main supply body 300. The main supply body 300 includes a first body part 302 to which the liquid containing portion 18 is welded and a second body part 304 in which the liquid detection chamber 305 is formed.

The first body part 302 includes the first opening 308, a second opening 306, and two projections 311 that protrude from a surface in which the first opening 308 is formed. The valve-mounted member 230 and the check valve 232 are fitted to the first opening 308. Ink contained in the liquid containing portion 18 flows into the first opening 308 through the valve-mounted member 230. The projections 311 hold the valve-mounted member 230. The second opening 306 communicates with a part of the liquid discharge flowpath 320 described later, which is located downstream of the check valve 232. The second opening 306 is described later. Note that, in this specification, the terms "upstream" and "downstream" are defined based on a direction in which ink flows when ink is supplied from the ink pack 14 to the printer.

The valve-mounted member 230 holds the check valve 232. An opening 233 and two through-holes 234 are formed in the valve-mounted member 230. As shown in FIG. 3, the through-holes 234 are fitted onto the projections 311, and, as a result, the valve-mounted member 230 is fixed to the main supply body 300. The check valve 232 controls the flow of ink from the main supply body 300 to the liquid containing portion 18, and, as a result, air bubbles, as well as ink, are prevented from intruding into the liquid containing portion 18. In more detail, the check valve 232 that is the valve body is sat on a valve seat of the valve-mounted member 230, and, as a result, ink is prevented from flowing from the main supply body 300 to the liquid containing portion 18.

As shown in FIG. 3, in order to fill the liquid containing portion 18 with ink, the liquid containing portion 18 is welded to an external surface part 302*a* of the external surface of the first body part 302 that is located closer to the open hole 303 than the second opening 306 and that is shown by the cross hatching in the FIG. 3. Thereafter, ink is injected into the liquid discharge flowpath 320 from the open hole 303. As a result, ink flows from the second opening 306 communicating with the liquid discharge flowpath 320, and the liquid containing portion 18 is filled with ink. After filling the liquid containing portion 18 with ink, the liquid containing portion 18 is welded to an external surface part 302*b* of the external surface of the first body part 302 that includes the second opening 306 and that is shown by the single hatching in the FIG. 3. Accordingly, the second opening 306 is closed by the liquid containing portion 18. This manner makes it possible to fill the liquid containing portion 18 with ink in spite of the fact that the check valve 232 which is used to prevent ink from flowing backwardly is disposed in the liquid discharge flowpath 320.

The second body part 304 includes a part of the liquid discharge flowpath 320 and the liquid detection chamber 305. The liquid detection chamber 305 is a space enclosed by the second body part 304. Various members which are used to detect the residual amount of a liquid contained in the ink pack 14 described later are disposed in the liquid detection chamber 305. For descriptive convenience, the surface of the liquid detection chamber 305 located on the side in the positive direction of the Z axis is defined as an upper surface, and the surface of the liquid detection chamber 305 located on the side in the negative direction of the Z axis is defined as a bottom surface in the following description.

The upper surface of the liquid detection chamber 305 includes an opening 305*a*. As shown in FIG. 4, the bottom surface of the liquid detection chamber 305 includes a sensor-disposing opening 305*b* formed to dispose a sensor base 240 described later. The sensor-disposing opening 305*b* is formed by being bored through a bottom member 304*b* of the second body part 304. As shown in FIG. 3, the spring 221, the movable member 400, and the sensor unit 220 are disposed in the liquid detection chamber 305. The flexible film 500 adheres to a projection 304*c* formed on the inside of a peripheral end surface 304*a* of the second body part 304 so as to close the opening 305*a* of the liquid detection chamber 305.

The movable member 400 includes a seal part 424, a spring holding part 425, and a contact part (through-hole forming part) 426. The movable member 400 is disposed in the liquid detection chamber 305 so as to be displaceable in the depth direction (i.e., up-down direction of the Z axis) of the liquid detection chamber 305. As shown in FIG. 3, the seal part 424 is a member that extends in the depth direction of the liquid detection chamber 305 and that is capable of coming into contact with the sensor unit 220. The spring holding part 425 is substantially cylindrically shaped, and holds the upper end side of the spring 221 by its inner peripheral surface. The external shape of the contact part 426 is substantially the same as the external shape of a space of a part of the liquid detection chamber 305 in which the contact part 426 is housed. Accordingly, when the movable member 400 is disposed in the liquid detection chamber 305, the movable member 400 is prevented from moving in the width direction (i.e., direction of the X axis) and in the length direction (i.e., direction of the Y axis) of the liquid detection chamber 305. Additionally, the contact part 426 includes a through-hole 430 through which the liquid detection chamber 305 and the downstream communication flowpath 324 (see FIG. 2) communicate with each other. The check valve 222 is disposed in the downstream communication flowpath 324. The check valve 222 controls the flow of ink running from the liquid discharge flowpath 320 to the liquid detection chamber 305 through the downstream communication flowpath 324. In other words, the check valve 222 regulates the flow of ink running from the open hole 303 (see FIG. 1) to the liquid detection chamber 305 (i.e., regulates the flow that is opposite in direction to the flow running when ink is supplied to the printer). More specifically, the check valve 222 is brought into contact with (i.e., is sat on) the contact part 426 of the movable member 400, and the through-hole 430 is closed, thus the valve is closed (see FIG. 3).

The spring 221 is held by a spring holder 310 that protrudes from the bottom surface of the liquid detection chamber 305 toward the upper surface thereof and by the spring holder 425 of the movable member 400, and urges both the sensor unit 220 and the seal part 424 in a direction in which the distance between the sensor unit 220 and the seal part 424 becomes greater. In other words, the spring 221 urges both the sensor unit 220 and the seal part 424 in a direction in which the volume of the liquid detection chamber 305 becomes larger.

As shown in FIG. 3, the sensor unit 220 includes a metallic (stainless-steel-made) sensor base 240, a resinous film 250, and a sensor 260 that is attached to a surface (back surface) of the sensor base 240. The sensor base 240 is housed in the sensor-disposing opening 305*b* (see FIG. 4) formed in the bottom surface of the liquid detection chamber 305. The peripheral edge of the sensor-disposing opening 305*b* and the sensor base 240 are covered with the film 250, and thereby the sensor base 240 is attached to the liquid detection chamber 305. An opening slightly larger than the external shape of the sensor 260 is formed in the middle of the film 250, and the sensor 260 is disposed at this slightly larger opening, and is fixed to the sensor base 240. The sensor base 240 includes two through-holes 240*a* and 240*b* that are bored therethrough in the thickness direction (i.e., up-down direction of the Z axis).

The sensor 260 includes a sensor cavity into which and from which ink contained in the liquid detection chamber 305 flows (also called a "communication flowpath") 262, a diaphragm 266 (see FIG. 6B), and a piezoelectric element 268 (see FIG. 6B), and outputs a detection signal which is used to detect the residual amount of ink contained in the ink pack 14 on the printer side. When these parts are assembled together as the sensor unit 220, the sensor cavity 262 and the liquid detection chamber 305 communicate with each other through the through-holes 240*a* and 240*b*.

The junction terminal 246 electrically connects together the sensor 260 and a circuit board (not shown) attached to the second case 16 (see FIG. 1). As shown in FIG. 3 and FIG. 5B, the junction terminal 246 is held by junction-terminal holders 309*a* and 309*b* the number of which is four in total and that protrude from the bottom surface and the side surface of the second body part 304. A signal output from the sensor 260 is transmitted to a control unit mounted in the printer through the junction terminal 246 and the circuit board. The liquid residual amount of the ink pack 14 is detected by the control unit.

As shown in FIG. 3, the seal unit 200 includes a sealing member 212, a valve member 214, and a compression coil spring 216, and these members 212, 214, and 216 are disposed in the liquid discharge flowpath 320 in this order in a direction close to the open hole 303. The sealing member 212 is a cylindrical member, and a space between the liquid discharge flowpath 320 and an ink supply needle of the printer is closed so that a gap is not produced between the inner wall of the liquid discharge flowpath 320 and the outer peripheral surface of the ink supply needle when the ink supply needle is inserted in the liquid discharge flowpath 320. The valve member 214 comes into contact with the sealing member 212 when an ink cartridge 10 (see FIG. 1) is not attached to the printer (i.e., when the ink supply needle is not inserted in the liquid discharge flowpath 320). As a result, an opening of the sealing member 212 is closed with a surface on an end side of the valve member 214 (i.e., with a surface of the valve member 214 on the side in the positive direction of the Y axis). The compression coil spring 216 urges the valve member 214 in a direction to come into contact with the sealing member 212. When the ink supply needle of the printer is inserted into the liquid discharge flowpath 320 from the open hole 303, the ink supply needle pushes the valve member 214 in a direction away from the sealing member 212. As a result, a gap is produced between the valve member 214 and the sealing member 212, and ink is supplied to the ink supply needle through the gap. Although the open hole 303 includes its opening closed with the film 210 when the ink cartridge 10 is produced, this film 210 is broken by the ink supply needle when the ink cartridge 10 is attached to the printer. The ink cartridge 10 (see FIG. 1) is attached to the printer so that a part of the ink cartridge 10 on the side in the positive direction of the X axis shown in FIG. 3 is placed as a lower side whereas another part of the ink cartridge 10 on the side in the negative direction of the X axis is placed as an upper side.

Figure 6A:
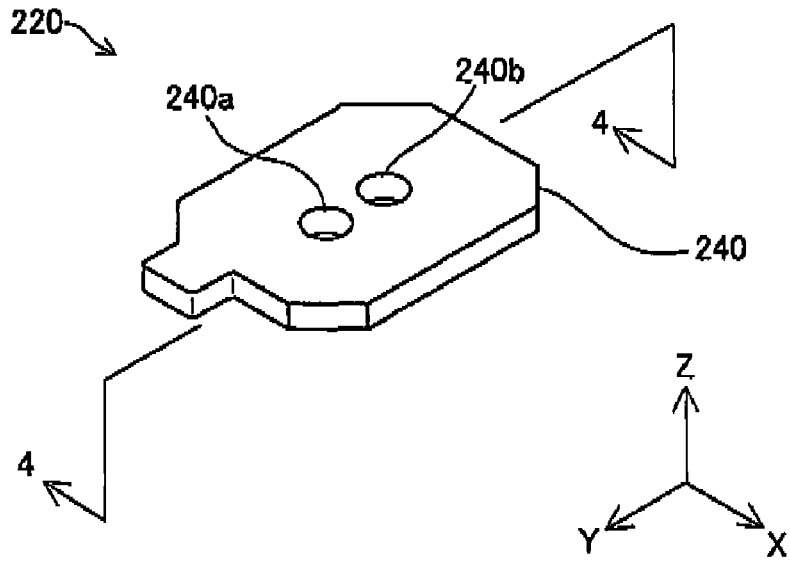
FIG. 6A and FIG. 6B are views for explaining a detailed structure of a sensor unit.
Figure 6B:
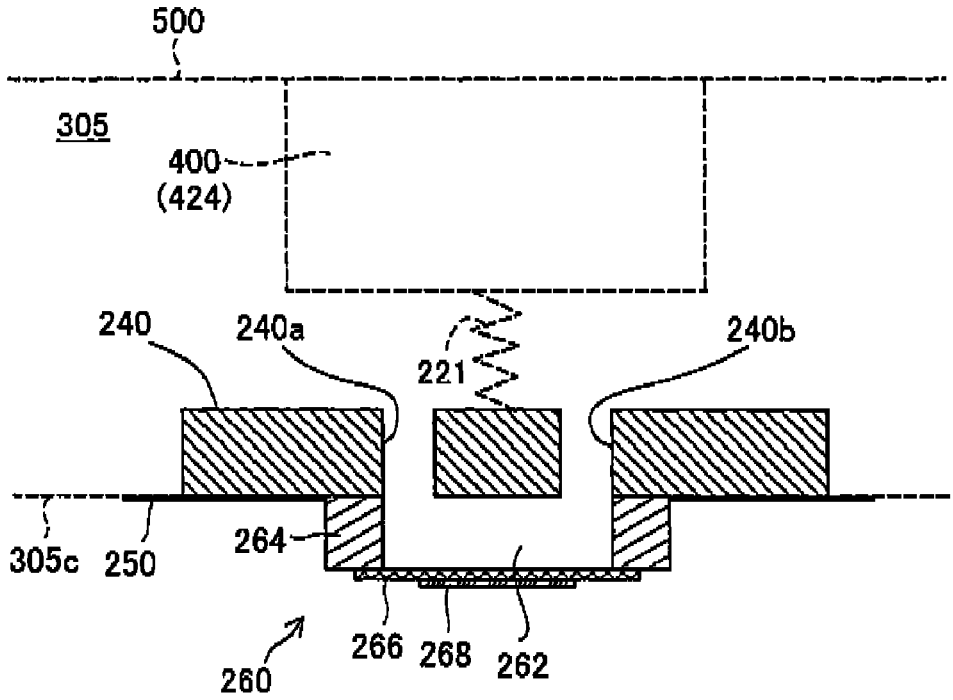

FIG. 6A and FIG. 6B are views for explaining a detailed structure of the sensor unit 220. FIG. 6A is a perspective view of the sensor unit 220 in which the film 250 (see FIG. 3) is not shown for the convenience of drawing. FIG. 6B is a cross sectional view along line 4-4 of FIG. 6A. For easy understanding, the movable member 400 disposed in the liquid detection chamber 305, the spring 221, the bottom surface 305*c* of the liquid detection chamber 305, and the flexible film 500 are shown by the dotted line in FIG. 6B.

In the sensor unit 220 shown in FIG. 6A, the sensor 260 is attached to the back surface of the sensor base 240 (i.e., surface on the side in the negative direction of the Z axis). As shown in FIG. 6B, the sensor 260 includes a ceramic body 264, the diaphragm 266, and the piezoelectric element 268. The diaphragm 266 is disposed on a surface (i.e., surface having an opening) of the body 264 which is opposite to the surface on which the sensor base 240 is disposed. The sensor cavity 262 is defined by the diaphragm 266 and the body 264. The sensor cavity 262 communicates with the liquid detection chamber 305 through the through-holes 240*a* and 240*b*.

When a predetermined driving signal is applied to the piezoelectric element 268, the piezoelectric element 268 is excited as an actuator for a predetermined time, and then the diaphragm 266 starts free vibrations. A counter-electromotive force occurs in the piezoelectric element 268 by the free vibrations of the diaphragm 266, and a waveform representing this counter-electromotive force is output to the control unit of the printer as a detection signal (also called a "waveform signal").

Herein, the state (amplitude or frequency) of the waveform signal is changed according to a change in the communication state between the sensor cavity 262 and the liquid detection chamber 305. For example, if the movable member 400 comes into contact with the sensor base 240, and the sensor cavity 262 and the liquid detection chamber 305 reach a non-communication state in which the sensor cavity 262 and the liquid detection chamber 305 do not communicate with each other, the diaphragm 266 will hardly vibrate even if a driving signal is applied to the piezoelectric element 268, and a linear waveform that has no change as a detection signal will be output. On the other hand, if the movable member 400 is kept away from the sensor base 240, and the sensor cavity 262 and the liquid detection chamber 305 are in a communication state, the diaphragm 266 will vibrate when a driving signal is applied to the piezoelectric element 268, and a waveform that has changes as a detection signal will be output. In other words, based on the state of ink in the sensor cavity 262 (i.e., based on whether ink in the sensor cavity 262 is in a state of communicating with the liquid detection chamber 305), the sensor 260 changes the output state of a detection signal.

As shown in FIG. 6B, in a state immediately after the ink pack 14 is filled with ink, the movable member 400 (in more detail, the seal part 424) and the sensor base 240 are kept away from each other. If ink contained in the liquid containing portion 18 (see FIG. 1) is quantitatively sufficient, negative pressure will be hardly generated in the liquid detection chamber 305 even if ink is supplied to the printer from the liquid containing portion 18 through the liquid detection chamber 305 by being sucked by the printer. Therefore, the urging force of the spring 221 (i.e., force of the spring 221 applied onto the movable member 400 in a direction in which the movable member 400 and the sensor base 240 are pulled away from each other) enables the movable member 400 and the sensor base 240 to maintain a state of being away from each other. On the other hand, if ink contained in the liquid containing portion 18 becomes quantitatively smaller, negative pressure (i.e., force that allows the movable member 400 and the sensor base 240 to approach each other) will be generated in the liquid detection chamber 305 by being sucked by the printer, and ink contained in the liquid containing portion 18 is reduced in amount, and the absolute value of the negative pressure becomes large, as the ink is reduced in amount. As a result, a separation distance between the movable member 400 and the sensor base 240 gradually becomes smaller, and, finally, the movable member 400 (in more detail, the seal part 424) comes into contact with the sensor base 240 so as to close the through-holes 240*a* and 240*b*. In other words, the sensor cavity 262 and the liquid detection chamber 305 reach a non-communication state in which the sensor cavity 262 and the liquid detection chamber 305 do not communicate with each other. From these facts, it can be determined that ink is hardly contained in the liquid containing portion 18 when the sensor 260 outputs a detection signal having no change, and can be determined that ink sufficient enough to be supplied to the printer is contained in the liquid containing portion 18 when the sensor 260 outputs a detection signal having changes.

Figure 7:
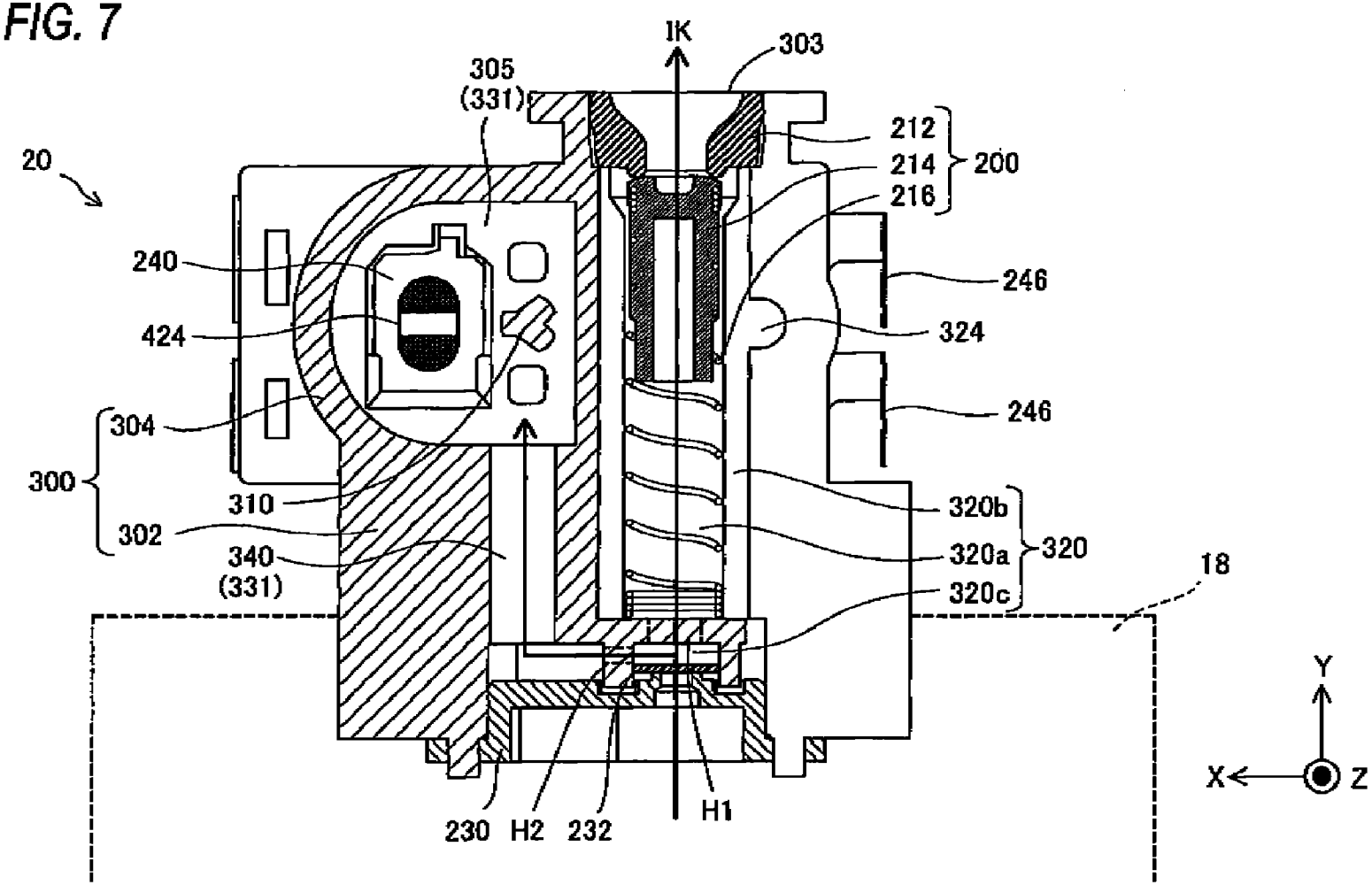
FIG. 7 is a cross-sectional view along line A-A of FIG. 5B.
Figure 8A:
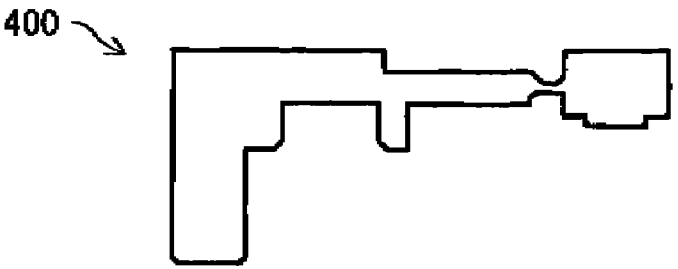
FIG. 8A and FIG. 8B are views for explaining a cross-section along line B-B of FIG. 5A.
Figure 8B:
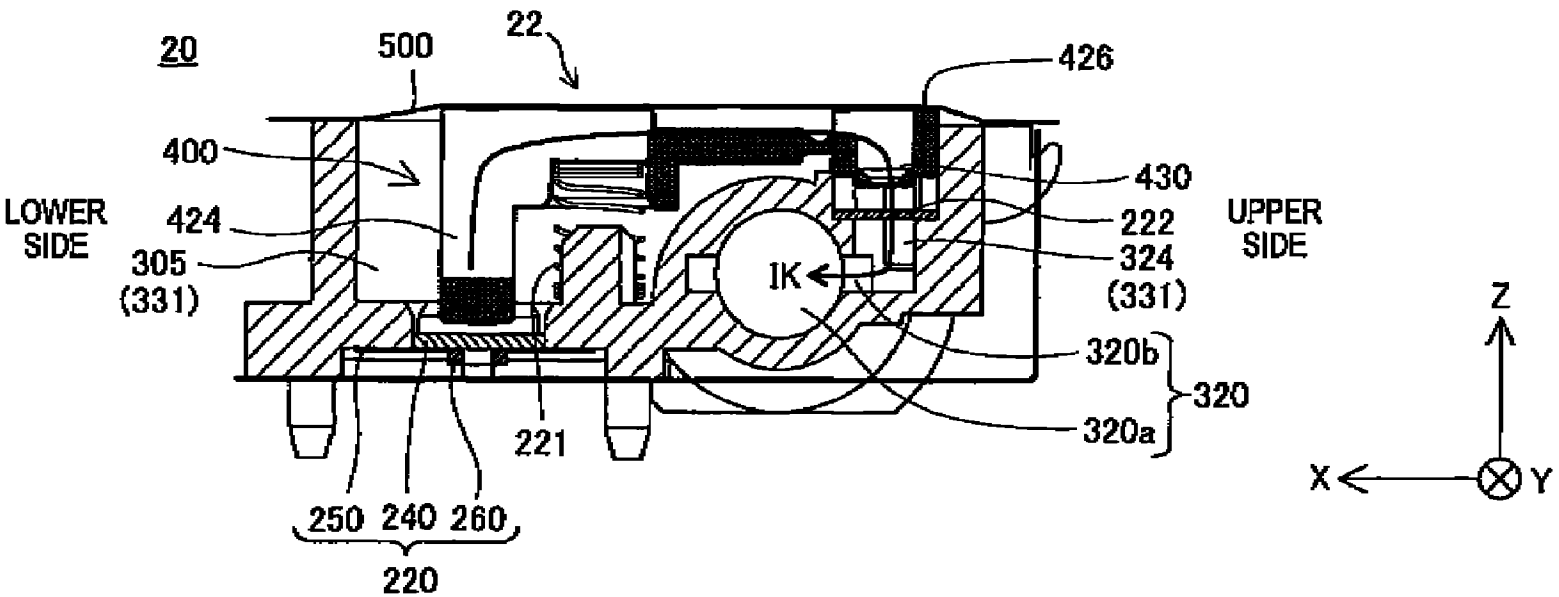
Figure 9:
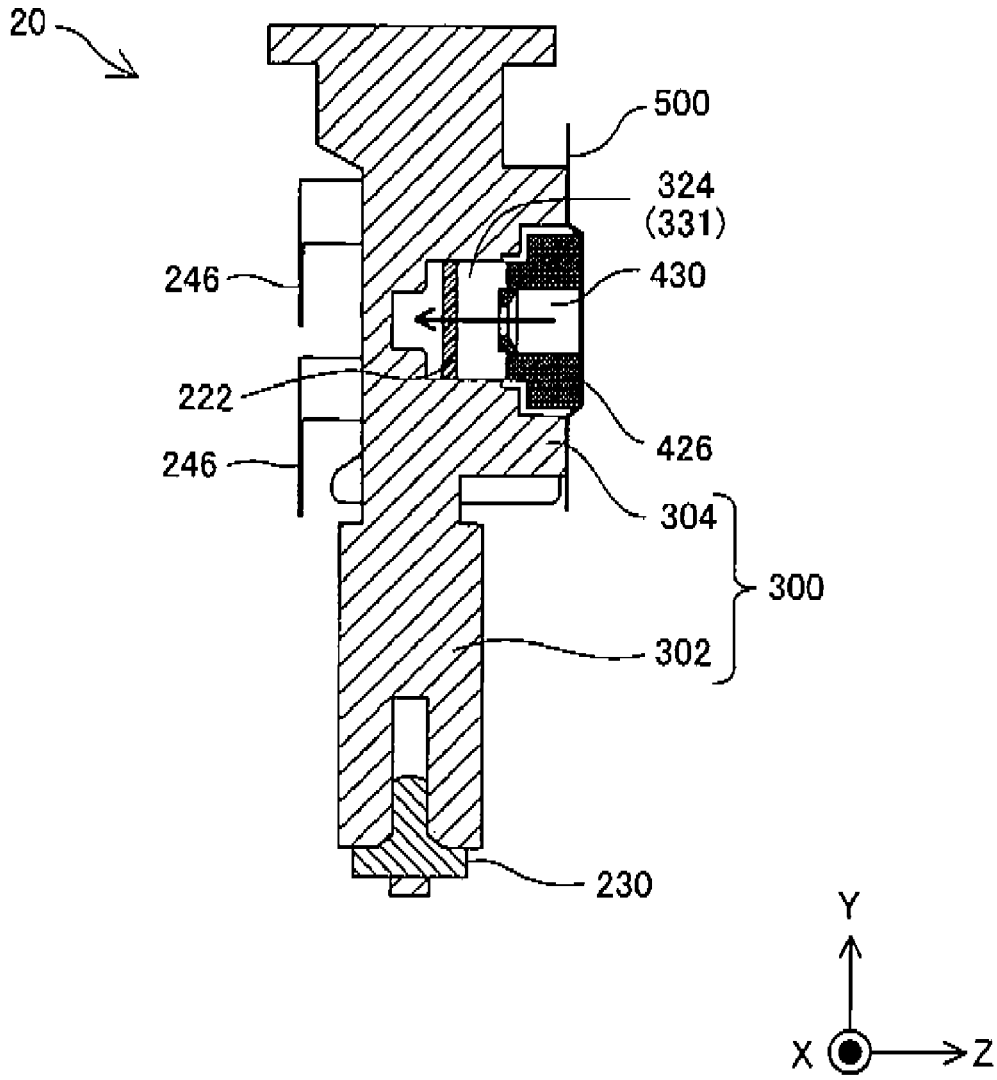
FIG. 9 is a cross-sectional view along line C-C of FIG. 5A.

Next, a detailed structure of the liquid supply portion 20 will be described with reference to FIG. 7 to FIG. 9. FIG. 7 is a cross-sectional view along line A-A of FIG. 5B. FIG. 8A and FIG. 8B are views for explaining a cross-section along line B-B of FIG. 5A. FIG. 9 is a cross-sectional view along line C-C of FIG. 5A. FIG. 8A is a view showing the external shape of the movable member 400 of FIG. 8B, and FIG. 8B is a cross-sectional view along line B-B of FIG. 5A. For the convenience of drawing, the seal unit 200 (see FIG. 2) is not shown in FIG. 8B.

As shown in FIG. 7 to FIG. 9, the main supply body 300 includes the liquid discharge flowpath 320 and the liquid detection flowpath 331. The liquid detection flowpath 331 includes the upstream communication flowpath 340 (see FIG. 7), the liquid detection chamber 305 (see FIG. 7 and FIG. 8B), and the downstream communication flowpath 324 (see FIG. 8B and FIG. 9). As shown in FIG. 8B, the sensor unit 220, the spring 221, the movable member 400, and the flexible film 500 are disposed in the liquid detection chamber 305, thus the liquid detecting portion 22 is made up.

The liquid detecting portion 22 is provided in the liquid supply portion 20 itself in this way, and, as a result, there is no need to form a connection part that is provided when the liquid supply portion 20 and the liquid detecting portion 22 are structurally-different components detachable from each other. Therefore, it is possible to reduce the possibility that gas (air) will enter and mix with ink contained in the ink pack 14 from the outside. Therefore, it is possible to reduce the number of cases in which false detection of the sensor 260 occurs. More specifically, for example, bubbles enter the sensor cavity 262, and, as a result, the state of a waveform signal output from the piezoelectric element 268 changes, and false detection occurs. Additionally, the possibility that bubbles will mix with ink contained in the ink pack 14 can be reduced, and therefore the number of cases in which the printer (in more detail, a recording head of the printer) cannot stably eject ink can be reduced. Therefore, it is possible to prevent the occurrence of defects of the ink pack 14 caused by allowing bubbles to mix with ink contained in the ink pack 14.

As shown in FIG. 7, the liquid discharge flowpath 320 includes a center flowpath 320*a*, a groove flowpath 320*b*, and a communication flowpath 320*c*. The center flowpath 320*a* is substantially circular in its cross-section as shown in FIG. 8B. The groove flowpath 320*b* consists of two flowpaths formed on the peripheral edge of the center flowpath 320*a*, each having a substantially rectangular cross-section. The communication flowpath 320*c* is a flowpath through which the center flowpath 320*a* and the liquid containing portion 18 communicate with each other as shown in FIG. 7. The communication flowpath 320*c* is provided with the check valve 232 that prevents ink from flowing from the liquid discharge flowpath 320 to the liquid containing portion 18. This makes it possible to prevent air bubbles, which have entered the liquid discharge flowpath 320 from the outside through the open hole 303, from flowing into the liquid containing portion 18. Through-holes H1 and H2 are bored in members forming the main supply body 300 which are located between the communication flowpath 320*c* and the upstream communication flowpath 340 and between the communication flowpath 320*c* and the center flowpath 320*a*, thus ink is enabled to pass through the members. As shown in FIG. 7, the liquid discharge flowpath 320 and the liquid detection flowpath 331 are formed in the main supply body 300 so as to be parallel to each other.

A structure in which the liquid discharge flowpath 320 and the liquid detection flowpath 331 are parallel to each other makes it possible to make the possibility that air bubbles will enter the sensor 260 smaller even if gas enters the liquid supply portion 20 from the open hole 303 than a structure in which the liquid discharge flowpath 320 and the liquid detection flowpath 331 are formed in series.

Additionally, the pressure of ink located in the liquid detection chamber 305 is influenced by the flow velocity of ink flowing through the liquid detection chamber 305, and therefore it is preferable to stop the flow of ink of the liquid detection chamber 305 and then apply a driving signal to the piezoelectric element 268 if the piezoelectric element 268 is used to detect the residual amount of ink as in this embodiment. In a structure in which a predetermined amount of ink is supplied to the printer through the two flowpaths 320 and 331 arranged in parallel with each other, the period of time during which the flow of ink of the liquid detection flowpath 331 is being stopped when the supply of ink to the printer is stopped can be made shorter than in a structure the two flowpaths 320 and 331 are arranged in series. Therefore, it is possible to shorten the period of time required for a process in which the flow of ink is stopped, thereafter a driving signal is applied to the piezoelectric element 268, and the residual amount of ink of the ink pack 14 is detected by the printer.

As shown in FIG. 7 and FIG. 8B, the sensor unit 220 (the sensor 260) is disposed on the upstream side of the liquid detection chamber 305, and the sensor 260 and the downstream communication flowpath 324 are in a positional relationship in which the liquid discharge flowpath 320 is placed therebetween.

As shown in FIG. 8B, the liquid detection chamber 305 intersects the liquid discharge flowpath 320 in a grade separation manner. In other words, the liquid detection chamber 305 and the liquid discharge flowpath 320 are formed so as to be partly overlapped with each other in the thickness direction of the liquid supply portion 20 (i.e., in the direction of the Z axis). This structure makes it possible to make the main supply body 300 compact while sufficiently securing the volume of the liquid detection chamber 305 (i.e., volume having such a degree as to contain the movable member 400) even if the liquid detection flowpath 331 is provided in the liquid supply portion 20.

Additionally, the grade separation between the liquid detection chamber 305 and the liquid discharge flowpath 320 makes it possible to enlarge the flowpath length of the liquid detection chamber 305 while making the liquid supply portion 20 compact. Accordingly, the sensor unit 220 is disposed on the upstream side of the liquid detection chamber 305 (for example, in the vicinity of a connection point between the upstream communication flowpath 340 and the liquid detection chamber 305), and, as a result, the possibility that air bubbles will enter the sensor 260 can be made smaller even if air bubbles enter the liquid detection chamber 305 through the downstream communication flowpath 324. Therefore, the occurrence of false detection of the sensor 260 can be reduced even more.

In a state in which the ink cartridge 10 is attached to the printer, the sensor 260 is disposed in the liquid detection chamber 305 so as to be located lower than the downstream communication flowpath 324. In other words, in a state in which the ink cartridge 10 is attached to the printer, the side in the positive direction of the X axis is a lower side, whereas the side in the negative direction of the X axis is an upper side in FIG. 8B. Therefore, the possibility that air bubbles will reach the sensor 260 can be reduced even more even when air bubbles that have passed through the open hole 303 and enter the liquid detection chamber 305 through the downstream communication flowpath 324. Therefore, the occurrence of false detection caused by air bubbles that have entered the sensor 260 can be reduced even more.

As described above, the liquid detecting portion 22 (see FIG. 1) is disposed in the liquid supply portion 20 itself, and, as a result, it is possible to reduce the occurrence of defects of the ink pack 14 caused by, for example, allowing gas to mix with ink contained in the ink pack 14.

B. Second Embodiment

Figure 10A:
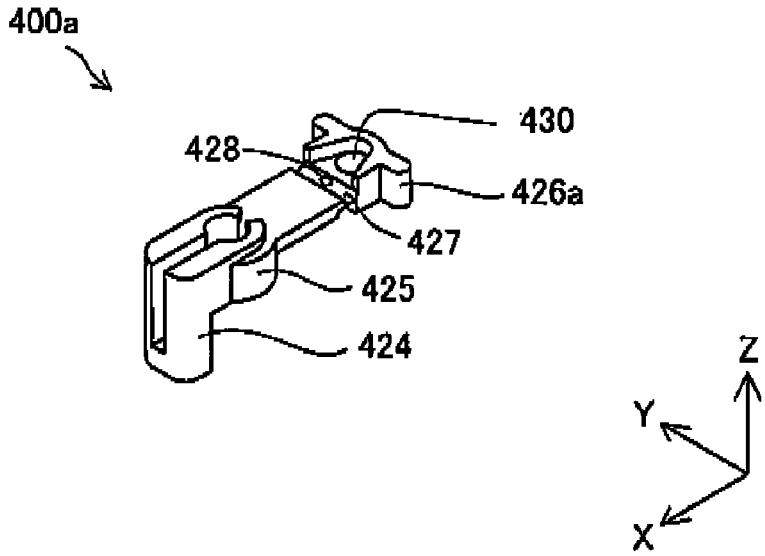
FIG. 10A and FIG. 10B are views for explaining a movable member according to a second embodiment of the present invention.
Figure 10B:
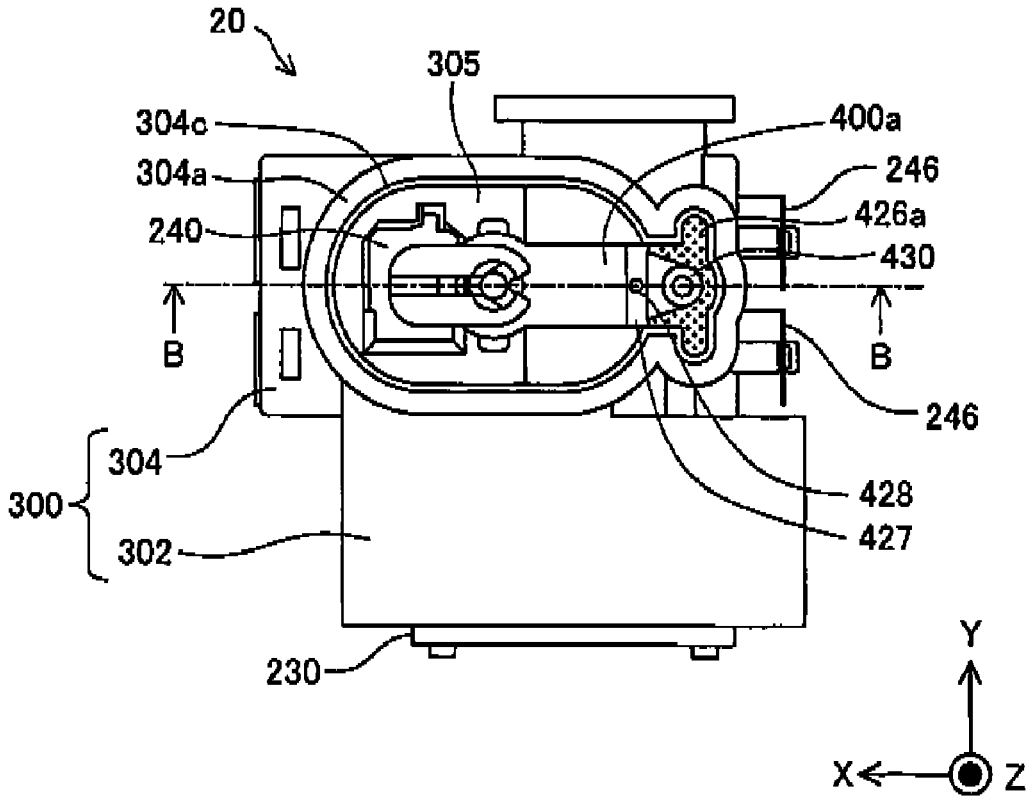

FIG. 10A and FIG. 10B are first views, respectively, for explaining a movable member 400*a*. FIG. 10A is a perspective view of the movable member 400*a*, and FIG. 10A is a view of the liquid supply portion 20 viewed from the positive side in the direction of the Z axis. The movable member 400*a* of the second embodiment differs from the movable member 400 of the first embodiment in how to house the movable member 400*a* in the liquid detection chamber 305 and in how the movable member 400*a* is displaced. The same reference numeral is given to the same structure as the movable member 400 of the first embodiment, and a description of the same structure is omitted. Likewise, the other structures (e.g., the main supply body 300 and so forth) are the same as those of the first embodiment, and therefore a description of these structures is omitted.

As shown in FIG. 10A, the movable member 400*a* includes a thin part 427. The thin part 427 includes a through-hole 428 bored therethrough in the thickness direction. The thin part 427 is formed between a contact part (through-hole forming part, fixation part) 426*a* and a seal part 424. The thin part 427 is smaller in thickness than the contact part 426*a* and the seal part 424.

The external shape of the contact part 426*a* is larger than the external shape of the contact part 426 of the first embodiment. In more detail, although the contact part 426 of the first embodiment is formed substantially in the same way as the external shape of the space of a part of the liquid detection chamber 305 in which the contact part 426 is housed, the contact part 426*a* of the second embodiment is formed slightly larger than the external shape of this space.

The movable member 400*a* is housed in the liquid detection chamber 305 (see FIG. 10B) by pressing and fitting the contact part 426*a* of the movable member 400*a* to a part of the liquid detection chamber 305. As a result, the contact part 426*a* is fixed to the liquid detection chamber 305. When the contact part 426*a* is fixed to the liquid detection chamber 305, the thin part 427 is deformed according to a change in an external force (i.e., pressure inside the liquid detection chamber 305 and the urging force of the spring 221) that is received by the movable member 400*a*, and, accordingly, the seal part 424 is displaced inside the liquid detection chamber 305. The flexible film 500 (see FIG. 3) adheres to the projection 304*c* and a part of the upper surface of the movable member 400*a* (i.e., the surface on the positive side in the direction of the Z axis), which is shown by dots in FIG. 10B (i.e., upper surface of the contact part 426*a*).

Figure 11A:
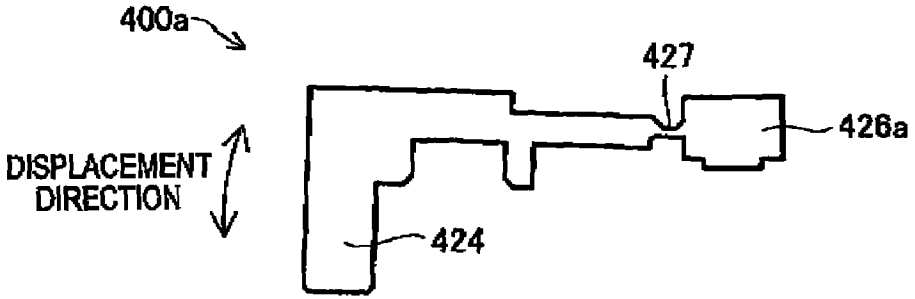
FIG. 11A and FIG. 11B are first views, respectively, for explaining a cross-section along line B-B of FIG. 10B.
Figure 11B:
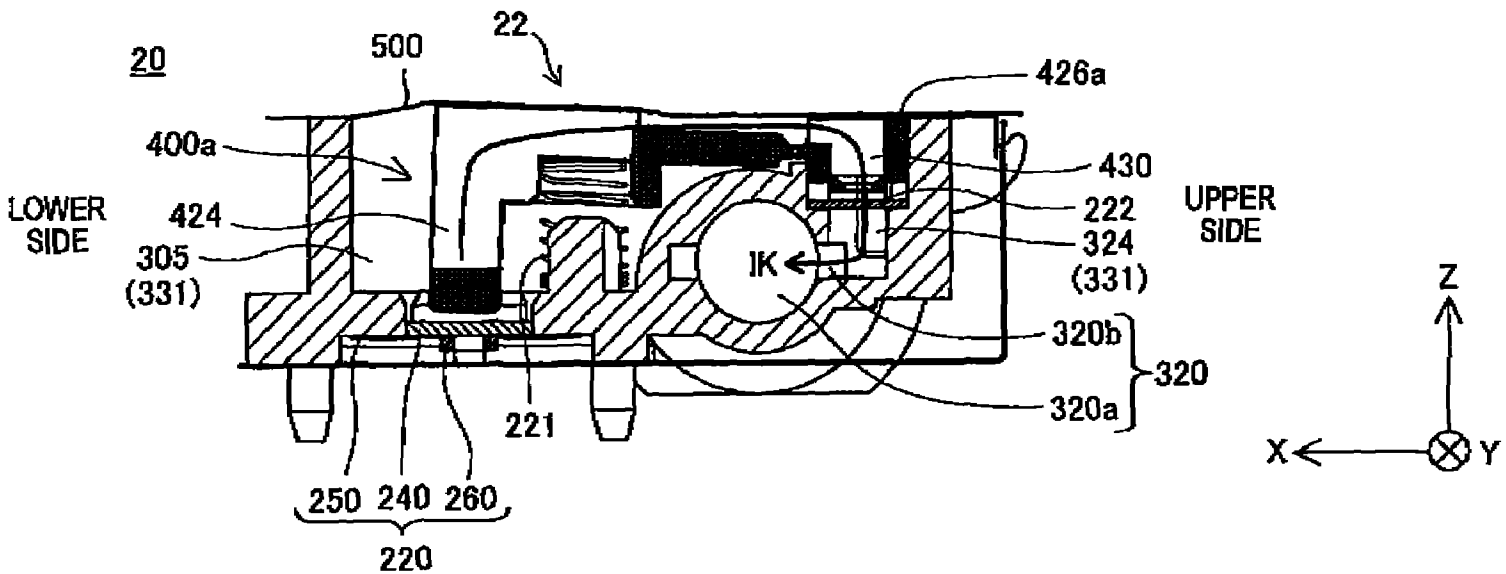
Figure 12A:
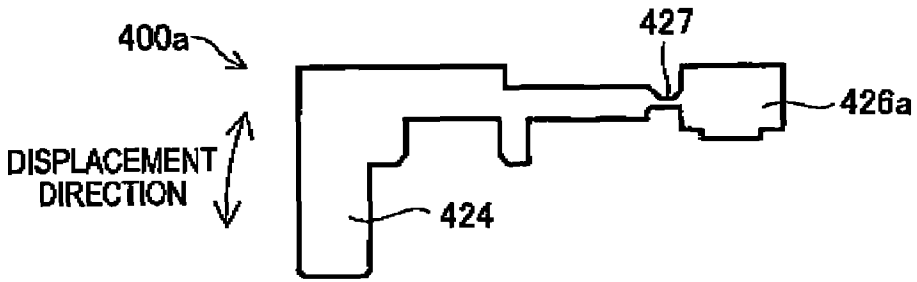
FIG. 12A and FIG. 12B are second views, respectively, for explaining the cross-section along line B-B of FIG. 10B.
Figure 12B:
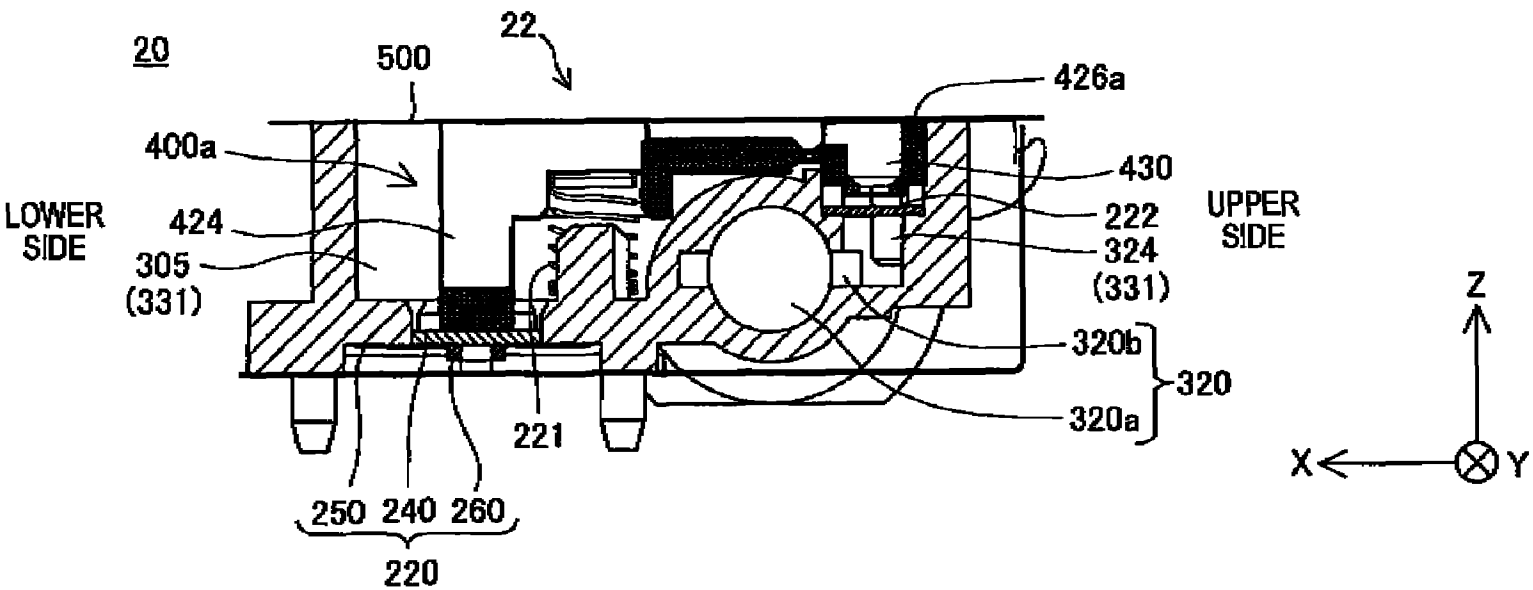

Next, the displacement manner of the movable member 400*a* will be described with reference to FIG. 11A to FIG. 12B. FIGS. 11A and 11B are first views, respectively, to describe a cross-section along line B-B of FIG. 10B. FIG. 11B is a cross-sectional view along line B-B of FIG. 10B in an ink-present state in which ink sufficient enough to be supplied to the printer is contained in the liquid containing portion 18, and FIG. 11A is a view showing the external shape of the movable member 400*a* in the state shown in FIG. 11B. FIGS. 12A and 12B are second views, respectively, to describe the cross-section along line B-B of FIG. 10B. FIG. 12B is a cross-sectional view along line B-B of FIG. 10B in an ink-end state in which ink is hardly contained in the liquid containing portion 18, and FIG. 12A is a view showing the external shape of the movable member 400*a* in the state shown in FIG. 12B.

As shown in FIG. 11B, when ink contained in the liquid containing portion 18 is in an ink-present state, the seal part 424 is displaced by the urging force of the spring 221 in a direction away from the sensor base 240 while allowing the thin part 427 to serve as an axis. As a result, the seal part 424 and the sensor base 240 are kept away from each other.

As shown in FIG. 12B, when ink contained in the liquid containing portion 18 is in an ink-end state, the absolute value of the negative pressure of the liquid detection chamber 305 becomes greater than the urging force of the spring 221, and the seal part 424 is displaced in a direction approaching the sensor base 240. As a result, the seal part 424 and the sensor base 240 come into contact with each other.

When ink contained in the liquid containing portion 18 is consumed, and a change is made from an ink-present state to an ink-end state in this way, the seal part 424 is displaced while using the thin part 427 as an axis, and, as a result, the sensor base 240 and the sealing member 212 reach a contact state from a separation state. Therefore, the movable member 400*a* can be more stably held in the liquid detection chamber 305 than in the first embodiment in which the whole of the movable member 400 is displaced. Additionally, the contact part 426*a* is fixed to the liquid detection chamber 305 by means of press fitting, and therefore the possibility that air bubbles will enter the sensor 260 of the liquid detection chamber 305 from a portion between the outer peripheral surface of the contact part 426*a* and the inner peripheral wall of the liquid detection chamber 305 can be reduced even more.

Figure 13A:
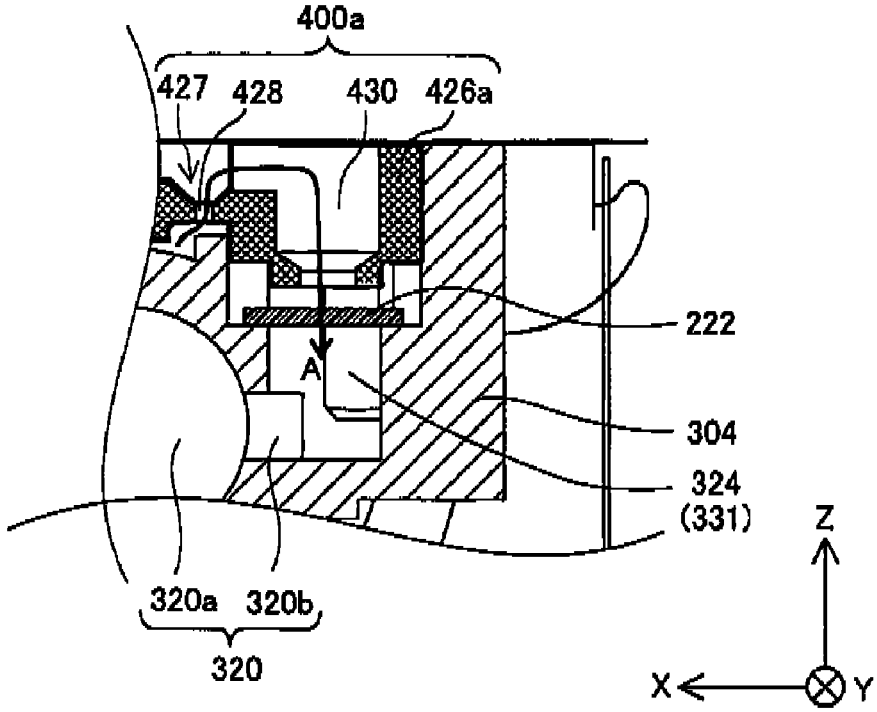
FIG. 13A and FIG. 13B are views for explaining the movable member and a check valve.
Figure 13B:
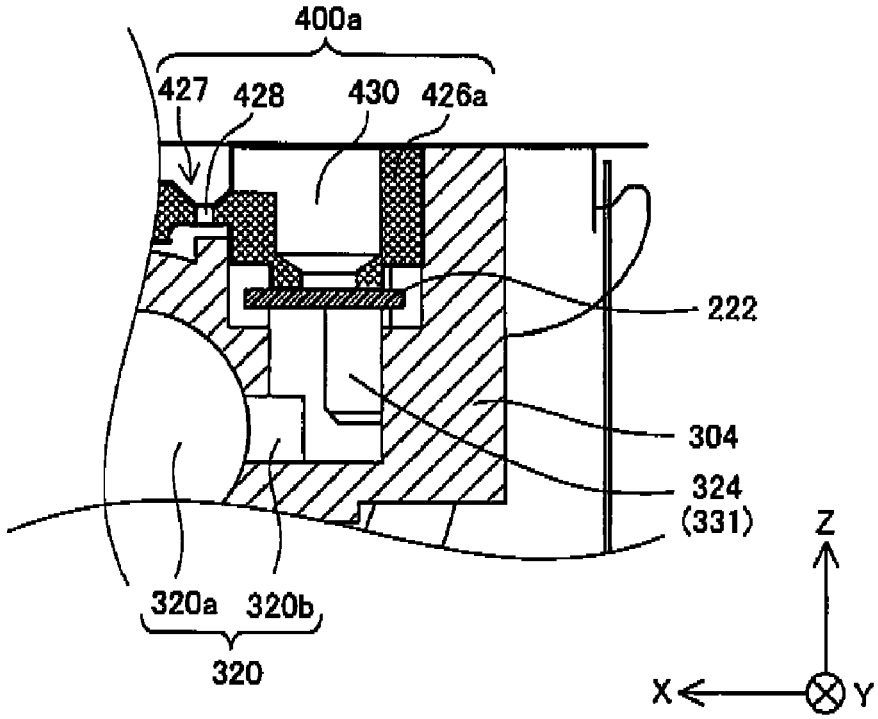

FIG. 13A and FIG. 13B are views for explaining the movable member 400*a* and the check valve 222. FIG. 13A is a partially sectional view along line B-B near the downstream communication flowpath 324 of FIG. 11B, and shows a state in which the check valve 222 is opened. FIG. 13B is a partially sectional view along line B-B near the downstream communication flowpath 324 of FIG. 11B, and shows a state in which the check valve 222 is closed. The check valve 222 and the through-hole 428 will be described with reference to FIG. 13A and FIG. 13B.

As shown in FIG. 13A, the formation of the through-hole 428 makes it possible to reduce the staying of air bubbles in the liquid detection chamber 305 and more smoothly discharge these air bubbles to the downstream communication flowpath 324 even when air bubbles enter the liquid detection chamber 305. For example, even when air bubbles enter a space of the liquid detection chamber 305 between the movable member 400*a* and the liquid discharge flowpath 320, these air bubbles can be smoothly discharged to the downstream communication flowpath 324 through the through-hole 428 as shown by arrow "A."

Next, the check valve 222 will be described. When ink flows from the liquid detection chamber 305 (see FIG. 11B) toward the downstream communication flowpath 324 as shown in FIG. 13A, the check valve 222 is kept away from the contact part 426*a*, and is in an open state. In this state, ink in the liquid detection chamber 305 passes through the through-hole 430, and flows to the downstream communication flowpath 324. A detour flowpath that detours around the check valve 222 in the positive direction of the Y axis and in the negative direction of the Y axis is formed at a part of the downstream communication flowpath 324 in which the check valve 222 is disposed. Ink flows from the upstream side of the check valve 222 to the downstream side through the detour flowpath.

On the other hand, when ink is about to flow from the liquid discharge flowpath 320 toward the liquid detection chamber 305 (i.e., when ink is about to flow in a direction opposite to the direction of a flow running when ink is supplied to the printer) as shown in FIG. 13B, the check valve 222 comes into contact with the contact part 426*a* and closes the through-hole 430, and, as a result, is in a closed state. In other words, the check valve 222 and the contact part 426*a* of the movable member 400*a* make up a check valve mechanism that inhibits the backward flow of ink. As shown in FIG. 13A and FIG. 13B, the check valve 222 has a slightly smaller diameter than the diameter of the flowpath cross-section of the downstream communication flowpath 324 in which the check valve 222 is housed so that the check valve 222 can easily reciprocate between both ends of a part of the downstream communication flowpath 324. The check valve 222 of the first embodiment is closed by being brought into contact with the contact part 426 (see FIG. 8B) in the same way as that of the second embodiment.

As described above, the contact part 426 of the movable member 400 (in the first embodiment) and the contact part 426*a* of the movable member 400*a* (in the second embodiment) function as valve seats, respectively, and therefore there is no need to newly provide a valve seat, and the number of components can be reduced.

As described above, in the second embodiment, the possibility that air bubbles will enter the liquid detection chamber 305 or will stay in the liquid detection chamber 305 can be reduced even more than in the first embodiment. Therefore, in the second embodiment, the occurrence of false detection caused by allowing air bubbles to enter the sensor 260 can be reduced even more than in the first embodiment.

C. Modifications

The present invention is not limited to the above-described embodiments or modes, and can be variously embodied within the range not departing from the gist of the present invention. For example, the following modifications can be carried out.

C-1. First Modification:

Although the liquid supply portion 20 has the liquid discharge flowpath 320 and the liquid detection flowpath 331 arranged in parallel with each other in the above-described embodiments, the two flowpaths may be arranged in series. For example, the liquid supply portion 20 may have the liquid detection flowpath 331 and the liquid discharge flowpath 320 arranged in series in this order based on a direction in which ink flows from the liquid containing portion 18 to the open hole 303. This modification achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively.

C-2. Second Modification:

The upstream communication flowpath 340 is connected to the liquid discharge flowpath 320 (see FIG. 7) in the above-described embodiments. However, instead of this structure, the upstream communication flowpath 340 may be connected to the liquid containing portion 18. Likewise, this modification achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively.

C-3. Third Modification:

Although the check valve 222 is disposed in the downstream communication flowpath 324 of the liquid detection flowpath 331 in the above-described embodiments, a structure may be employed in which the check valve 222 is not disposed therein. Likewise, this modification achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively.

Additionally, although the contact parts 426 and 426*a* of the movable members 400 and 400*a* are provided to function as valve seats, respectively, in the above-described embodiments, a valve seat may be newly disposed in the downstream communication flowpath 324. This structure also makes it possible to inhibit the flow of ink from the liquid discharge flowpath 320 to the liquid detection chamber 305.

C-4. Fourth Modification:

Although the sensor 260 including the piezoelectric element 268 is used to detect the ink residual amount of the ink pack in the above-described embodiments, the present invention is not limited to this. For example, two electrode pins in which an energized state changes in accordance with the ink residual amount of the liquid detection chamber 305 may be disposed in the liquid detection chamber so as to serve as sensors, respectively. For example, if the ink pack is filled with electroconductive ink, the two electrode pins reach an energized state when the liquid detection chamber is filled with this ink. The two electrode pins reach a non-energized state when this ink is consumed, and, as a result, the liquid detection chamber is filled with gas.

C-5. Fifth Modification:

Although the liquid detection flowpath 331 and the liquid discharge flowpath 320 are formed in the main supply body 300 so as to intersect with each other in a grade separation manner in the above-described embodiments, the present invention is not limited to this. For example, a structure may be employed in which the liquid detection flowpath 331 and the liquid discharge flowpath 320 do not intersect with each other in a grade separation manner in the thickness direction of the liquid supply portion 20. Additionally, although the sensor 260 is disposed upstream of the liquid detection chamber 305, the present invention is not limited to this, and the sensor 260 may be disposed at an arbitrary position of the liquid detection chamber 305. This modification achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively.

C-6. Sixth Modification:

Although the main supply body 300 is integrally molded by use of synthetic resin in the above-described embodiments, the present invention is not limited to this. More specifically, if the liquid discharge flowpath 320 and the liquid detection flowpath 331 are made of an integrally-molded member, the other members (for example, the junction-terminal holder 309*a*) are not required to be integrally molded. Additionally, even if the liquid discharge flowpath 320 and the liquid detection flowpath 331 are formed by separate members, respectively, both members (i.e., a liquid-discharge-flowpath forming member and a liquid-detection-flowpath forming member) may be formed so that both members are fastened not to be detached from each other and so that gas does not enter the ink pack 14 from spaces other than the open hole 303. This modification also achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively, that are detachable from each other.

C-7. Seventh Modification:

Although the valve-mounted member 230 and the check valve 232 are provided in the above-described embodiments, the valve-mounted member 230 and the check valve 232 are not necessarily required to be provided. This modification also achieves a structure in which the liquid detecting portion 22 is provided in the liquid supply portion 20 itself, and hence makes it possible to make the occurrence of defects in the ink pack smaller than a structure in which the liquid supply portion and the liquid detecting portion are provided as structurally-different components, respectively.

C-8. Eighth Modification:

The sensor 260 using the piezoelectric element 268 in the above-described embodiments can be modified so as to realize its function by a manner of supplying ink to the printer. For example, if ink is supplied to the printer by pressing the ink pack 14 instead of the supply of ink by sucking, it is recommended to make modifications as follows.

Instead of the spring 221 used in the above-described embodiments, a spring is provided to urge the sensor unit 220 and the seal part 424 (see FIG. 8B) in a direction in which the distance therebetween becomes shorter. In other words, a spring is provided to urge the sensor unit 220 and the seal part 424 in a direction in which the volume of the liquid detection chamber 305 becomes smaller. Immediately after the ink pack 14 is filled with ink, the movable member 400 (in more detail, the seal part 424) and the sensor base 240 are in contact with each other. If ink is sufficiently contained in the liquid containing portion 18, a sufficient amount of ink flows into the liquid detection chamber 305, and a great liquid pressure (i.e., force by which the movable member 400 and the sensor base 240 are pulled away from each other) is generated in the liquid detection chamber 305. As a result, the sensor unit 220 and the seal part 424 are separated from each other. On the other hand, when ink contained in the liquid containing portion 18 becomes smaller in amount, pressure against the ink pack 14 is not transmitted to ink in spite of the fact that the ink pack 14 is being pressed, and ink does not flow into the liquid detection chamber 305. As a result, a sufficient liquid pressure is not generated in the liquid detection chamber 305, and the movable member 400 is brought into contact with the sensor base 240 by the urging force of the spring.

C-9. Ninth Modification:

The second flowpath (liquid detection flowpath) may include a downstream communication flowpath through which the liquid detection chamber and the first flowpath (liquid discharge flowpath) communicate with each other and which allows a liquid that has flowed in the second flowpath from the first flowpath or from the liquid containing portion to flow to the first flowpath when a liquid contained in the liquid container is supplied to the liquid ejecting apparatus, and a check valve that inhibits a liquid flow from the first flowpath to the liquid detection chamber may be disposed in the downstream communication flowpath.

This modification also makes it possible to even more reduce the possibility that air will enter the sensor by using the check valve.

C-10. Tenth Modification:

Although the ink pack 14 for use in the printer is taken as an example of the liquid container in the above-described embodiments, the present invention is not limited to this, and the liquid container of the present invention can be used in various liquid ejecting apparatuses.

Concrete examples of such liquid ejecting apparatuses include an apparatus including a color-material ejecting head such as a liquid crystal display, an apparatus including an electrode-material (electroconductive paste) ejecting head used to form electrodes such as a field emission display (FED) and an organic EL display, an apparatus including a living-organic-substance ejecting head used to produce biochips, an apparatus including a sample ejecting head that serves as a precision pipette, a textile printing apparatus, and a microdispenser.

When the liquid container 14 is used in these various liquid ejecting apparatuses, it is recommended to allow the liquid container 14 to contain a liquid corresponding to the kind of liquids ejected by the various liquid ejecting apparatuses.

Additionally, the manufacturing method of the present invention is applicable to the liquid container 14 containing various liquids. For example, liquids ejected by the various liquid ejecting apparatuses (e.g., color materials, electroconductive paste, and living organic substances) can be described as the various liquids.

According to an aspect of the invention, a connection part, which is provided when the liquid supply portion and the liquid detecting portion are structurally-different components, is not formed by providing the liquid detecting portion in the liquid supply portion itself. Therefore, the occurrence of defects in the liquid container, such as the entrance and mixture of air (gas) with a liquid contained in the liquid container from the outside, can be reduced.

According to an aspect of the invention, the possibility that air will enter the sensor can be made smaller even when air enters the liquid supply portion from the opening of the liquid supply portion than a structure in which the first flowpath (liquid discharge flowpath) and the second flowpath (liquid detection flowpath) are arranged in series (i.e., a structure in which one flowpath is formed in the liquid supply portion and in which the liquid detection chamber is disposed in this one flowpath). The second flowpath allows a liquid contained in the liquid containing portion to flow to the liquid ejecting apparatus, however, the liquid contained in the liquid containing portion may indirectly flow to the liquid ejecting apparatus. In other words, a liquid that has flowed through the second flowpath may flow to the first flowpath, and this liquid may flow to the liquid ejecting apparatus through the first flowpath.

According to an aspect of the invention, the possibility that air will enter the sensor can be reduced even more by the check valve.

According to an aspect of the invention, in a state in which the liquid container is attached to the liquid ejecting apparatus, the possibility that air will enter the sensor can be reduced even more even if air enters the liquid supply portion from the opening of the liquid supply portion.

According to an aspect of the invention, the residual state of a liquid contained in the liquid container can be detected with accuracy by analyzing a waveform signal output from the piezoelectric element.

According to an aspect of the invention, the movable member of the liquid detecting portion is used as a valve seat, and therefore there is no need to newly use a valve seat. Therefore, the number of components can be reduced, and a liquid is inhibited from flowing to the liquid detection chamber from the opening.

According to an aspect of the invention, the residual state of a liquid contained in the liquid container can be detected with accuracy by analyzing a waveform signal output from the piezoelectric element even if the supply of a liquid from the liquid container to the liquid ejecting apparatus is performed by sucking the liquid of the liquid container from the liquid ejecting apparatus.

According to an aspect of the invention, the residual state of a liquid contained in the liquid container can be detected with accuracy by analyzing a waveform signal output from the piezoelectric element even if the supply of a liquid from the liquid container to the liquid ejecting apparatus is performed by pressing the liquid container from the outside.

According to an aspect of the invention, the movable member can be more stably held in the liquid detection chamber than a structure in which the movable member is not fixed.

The present invention can be embodied in various forms, and in addition to the structure formed as the above-described liquid container, can be realized in a mode in which, for example, a liquid ejecting apparatus includes any one of the liquid containers structured as above.

What is claimed is:

1. A liquid container, operable to supply a liquid to a liquid ejecting apparatus, the liquid container comprising:

a liquid containing portion capable of containing the liquid;

a liquid supply portion one end of which is connected to the liquid containing portion and the other end of which includes an opening which opens outwardly, the liquid supply portion allowing the liquid to flow from the liquid containing portion to the liquid ejecting apparatus and including a liquid detecting portion which is operable to detect an amount of the liquid in the liquid container which liquid detecting portion includes a liquid detection chamber that contains the liquid supplied from the liquid containing portion and a sensor that is disposed in the liquid detection chamber and that outputs a detection signal which is used to detect the amount of the liquid in the liquid container; and a check valve that prevents a liquid from flowing to the liquid detection chamber from the opening, the check valve disposed in a downstream flowpath located downstream of the liquid detection chamber in the liquid supply portion in a flow direction in which the liquid is supplied to the liquid ejecting apparatus;

wherein the sensor includes:

a communication flowpath that communicates with the liquid detection chamber;

a diaphragm that is a part of the communication flowpath; and a piezoelectric element that outputs a waveform signal corresponding to a residual vibration waveform resulting from vibrations applied to the diaphragm, the check valve includes a valve body and a valve seat, the liquid detection chamber includes an opening portion in a surface facing the sensor; and the liquid detecting portion includes a flexible element with which the opening portion is closed and which is deformed in accordance with pressure of an inside of the liquid detection chamber; and a movable member, at least one part of the movable member being displaced in accordance with deformation of the flexible element, the movable member capable of bringing the liquid detection chamber and the communication flowpath of the sensor into a non-communication state by displacement of the movable member, the movable member including a through-hole-forming part which functions as the valve seat and in which a through-hole, through which the liquid detection chamber and the downstream flowpath communicate with each other, is formed.

2. A liquid container, operable to supply a liquid to a liquid ejecting apparatus, the liquid container comprising:

a liquid containing portion capable of containing the liquid; and a liquid supply portion one end of which is connected to the liquid containing portion and the other end of which includes an opening which opens outwardly, the liquid supply portion allowing the liquid to flow from the liquid containing portion to the liquid ejecting apparatus and including a liquid detecting portion which is operable to detect an amount of the liquid in the liquid container;

wherein the liquid detecting portion includes:

a liquid detection chamber that contains the liquid supplied from the liquid containing portion;

a sensor that is disposed in the liquid detection chamber and that outputs a detection signal which is used to detect the amount of the liquid in the liquid container;

a flexible element with which the opening portion is closed and which is deformed in accordance with pressure of an inside of the liquid detection chamber;

a movable member, the movable member being in contact with the flexible element in the liquid detection chamber, at least one part of the movable member being displaced in accordance with deformation of the flexible element, the movable member capable of bringing the liquid detection chamber and the communication flowpath of the sensor into a non-communication state by displacement of the movable member; and a spring which urges the movable member and the sensor so that a distance between the movable member and the sensor becomes greater the sensor includes:

a communication flowpath that communicates with the liquid detection chamber;

a diaphragm that is a part of the communication flowpath; and a piezoelectric element that outputs a waveform signal corresponding to a residual vibration waveform resulting from vibrations applied to the diaphragm; and the liquid detection chamber includes:

an opening portion in a surface facing the sensor.

3. The liquid container according to claim 2, wherein the movable member includes:

a fixation part fixed to the liquid detection chamber; and a seal part capable of bringing the liquid detection chamber and the communication flowpath of the sensor into a non-communication state by displacement of the seal part.

4. A liquid container, operable to supply a liquid to a liquid ejecting apparatus, the liquid container comprising:

a liquid containing portion capable of containing the liquid; and a liquid supply portion one end of which is connected to the liquid containing portion and the other end of which includes an opening which opens outwardly, the liquid supply portion allowing the liquid to flow from the liquid containing portion to the liquid ejecting apparatus and including a liquid detecting portion which is operable to detect an amount of the liquid in the liquid container;

wherein the liquid detecting portion includes a liquid detection chamber that contains the liquid supplied from the liquid containing portion;

a sensor that is disposed in the liquid detection chamber and that outputs a detection signal which is used to detect the amount of the liquid in the liquid container;

a flexible element with which the opening portion is closed and which is deformed in accordance with pressure of an inside of the liquid detection chamber;

a movable member, the movable member being in contact with the flexible element in the liquid detection chamber, at least one part of the movable member being displaced in accordance with deformation of the flexible element, the movable member capable of bringing the liquid detection chamber and the communication flowpath of the sensor into a non-communication state by displacement of the movable member; and a spring which urges the movable member and the sensor so that a distance between the movable member and the sensor becomes smaller;

the sensor includes:

a communication flowpath that communicates with the liquid detection chamber;

a diaphragm that is a part of the communication flowpath; and a piezoelectric element that outputs a waveform signal corresponding to a residual vibration waveform resulting from vibrations applied to the diaphragm; and the liquid detection chamber includes:

an opening portion in a surface facing the sensor.

5. The liquid container according to claim 4, wherein the movable member includes:

a fixation part fixed to the liquid detection chamber; and a seal part capable of bringing the liquid detection chamber and the communication flowpath of the sensor into a non-communication state by displacement of the seal part.

* * * * *